US009242781B1

(12) United States Patent
Struthers

(10) Patent No.: US 9,242,781 B1
(45) Date of Patent: Jan. 26, 2016

(54) PACKAGING AND DISPLAY SYSTEM

(71) Applicant: Ferrara Candy Company, Oakbrook Terrace, IL (US)

(72) Inventor: Kenneth C Struthers, Hixson, TN (US)

(73) Assignee: Ferrara Candy Company, Oakbrook Terrace, IL (US)

( * ) Notice: Subject to any disclaimer, the term of this patent is extended or adjusted under 35 U.S.C. 154(b) by 0 days.

(21) Appl. No.: 14/621,848

(22) Filed: Feb. 13, 2015

(51) Int. Cl.

| | |
|---|---|
| ***B65D 77/04*** | (2006.01) |
| ***B65D 73/00*** | (2006.01) |
| ***B65D 75/52*** | (2006.01) |
| ***B65D 85/20*** | (2006.01) |

(52) U.S. Cl.
CPC ..... *B65D 77/0433* (2013.01); *B65D 73/0021* (2013.01); *B65D 75/522* (2013.01); *B65D 85/20* (2013.01)

(58) Field of Classification Search
CPC ..... B65D 1/34; B65D 1/36; B65D 5/503; B65D 5/5038; B65D 5/504; B65D 73/0021; B65D 75/522; B65D 77/0433; B65D 85/20
USPC ..... 206/277, 332, 365, 380, 422, 426, 443, 206/476, 485–490, 526, 562–563, 780, 206/799; 211/13; 426/104, 119, 392, 660; 229/120.15, 149, 167
See application file for complete search history.

(56) References Cited

U.S. PATENT DOCUMENTS

| | | | | |
|---|---|---|---|---|
| 1,158,916 | A * | 11/1915 | Goldsmith | A47F 5/112 206/371 |
| 1,585,498 | A * | 5/1926 | Kenyon | B65D 5/5061 100/917 |
| 1,755,234 | A | 4/1930 | Westerfield | |
| 4,158,408 | A | 6/1979 | Thiessen | |
| 4,181,220 | A * | 1/1980 | Zicko | B65D 5/5035 206/315.2 |
| 4,341,308 | A * | 7/1982 | Pasquini | B65D 5/5052 206/427 |
| 4,450,965 | A | 5/1984 | Paillet | |
| 5,474,171 | A | 12/1995 | Niesen et al. | |
| 5,505,309 | A | 4/1996 | Taravella et al. | |
| 5,829,587 | A * | 11/1998 | Saiki | B65D 5/4208 206/327 |
| 6,019,224 | A * | 2/2000 | Rich | B65D 71/72 206/546 |
| 6,059,113 | A * | 5/2000 | Hodges | B65D 5/4204 206/443 |
| 6,386,366 | B1 * | 5/2002 | Friedman | B65D 5/52 206/45.3 |
| 6,935,505 | B1 * | 8/2005 | Nash, Jr. | B65D 71/72 206/485 |
| 7,743,921 | B2 * | 6/2010 | Hubbs | B65D 5/4204 206/225 |

(Continued)

OTHER PUBLICATIONS

Smartie 6-inch candy canes (before/on Dec. 3, 2008) http://blog.sweetservices.com/sweetcandyblog/2008112/smartie-6inch-candy-canes.html., 2pgs.

*Primary Examiner* — Bryon Gehman
*Assistant Examiner* — Brijesh V. Patel
(74) *Attorney, Agent, or Firm* — Merchant & Gould P.C.

(57) ABSTRACT

A packaging system is particularly figured for storing candy canes in a side-by-side presentation while providing support and protection to resist breaking of the candy canes. The system includes a rectangular box with an insert. The insert loads through the top of an open box and includes cross pieces for maintaining the long portion of the candy canes away from the front of the box. The inserts also include an extended bottom that extends outward beyond the front of the insert with the front edge of the bottom engaging the inner wall of the front of the box to space the insert and the long portion of the candy canes away from the front of the box.

13 Claims, 9 Drawing Sheets

(56) References Cited

U.S. PATENT DOCUMENTS 8,646,608 B2 2/2014 Struthers et al.
2001/0040113 A1* 11/2001 Wong ..... B65D 5/5021 206/485
2004/0084348 A1* 5/2004 Nash, Jr. ..... B65D 81/36 206/562
2012/0298547 A1* 11/2012 Collier ..... B65D 5/5038 206/592

* cited by examiner

PACKAGING AND DISPLAY SYSTEM

BACKGROUND OF THE INVENTION

1. Field of the Invention

The present invention is directed to a storage and packaging system for candy canes and a method for making, storing and packaging candy canes.

2. Description of the Prior Art

Many types of packaging have been developed for holding fragile articles during shipment and for displaying the articles for sale. It can be appreciated that certain articles may require added support and positioning within the packaging during storage and shipment. Moreover, such packaging should be lightweight, recyclable and made from readily available materials while being inexpensive and easy to manufacture. The packaging should also provide for displaying the articles in a manner that increases the attraction of the product for potential purchasers.

Certain types of articles such as candy canes are among those that are difficult to display and ship. Moreover, candy canes have a large demand around the winter holidays but may need to be produced all year due to costs and production capacities. Therefore, storing the fragile candy canes prior to shipment to retailers provides additional challenges. Although the candy canes may be produced many months prior to shipping, the packaging may need to be updated from year to year and may not be ready when the candy canes are made. Therefore, placing the candy canes in the packaging prior to placement may cause storage issues and production shortfalls.

Prior packaging and display devices configured especially for candy canes are known. U.S. Pat. No. 8,646,608 assigned to Ferrara Candy Company, the Assignee of the present invention, provides a box and tray that supports multiple candy canes within the box while maintaining the candy canes in position space away from the outer walls of the box. Although this system is very useful for shipping, the inner tray may not be optimal for storing the candy canes if they need to be manufactured and then stored for an extended period of time prior to insertion into boxes and then shipping.

It can be appreciated that a new and improved candy cane storage system is needed. Such a system should provide for inexpensive and simple manufacture as well as for storage in a safe manner and then simple direct loading into a box the top of a box. Moreover, such a system should retain the candy canes so that the candy canes and the insert can be loaded into the box at a time subsequent to manufacture. Such a system should also provide for easily loading boxes into larger cartons for shipment, storage and/or sale and provide for displaying the candy canes in a pleasing manner. The present invention addresses these as well as other problems associated with production, storing, packaging and displaying candy canes.

SUMMARY OF THE INVENTION

The present application is directed to a packaging system and in particular to a packaging system for supporting, storing and displaying candy canes. The packaging system includes an insert that supports the candy canes in a side-by-side configuration for top loading in a box.

The storage system includes a box made out of cardboard or other conventional card stock is cut and folded to define a rectangular box with a front, back, opposed sides, a top and a bottom. The front may include a window that may be covered with a transparent film that provides for outside viewing of the box contents. Moreover, the top includes a flap so that the box is opened and the insert may be loaded through the top and then the box closed for shipping.

An insert is configured to be placed inside the box. The insert may also be made from cardboard or other conventional card stock from a planar blank. The insert includes a front portion, back, opposed sides and a bottom. The front and back are spaced apart from one another with the front including cross pieces that are spaced apart and form a space between the top and bottom for loading the elongate portion of the candy canes. The cross pieces are spaced apart and are also spaced from the top of the insert to provide for loading of the candy canes long end first into the top of the inset with the hook extending over the first cross piece. The bottom of the insert extends outward beyond the front of the insert and also serves as a spacer for positioning the insert within the box. The insert loaded with candy canes slides bottom first through the open top of the box. The front edge of the bottom of the insert engages an inner wall of the front of the box. The back of the insert rests against the back of the box. The candy canes are supported so that at least a portion of them is visible through the window of the box with the long portions spaced inward from the front of the box.

Two or more of the loaded boxes may also be further packaged within a larger carton. The loaded boxes provide for a modular type system for achieving candy cane packages having various numbers of candy canes. The cartons may be utilized to store two boxes in a side-by-side configuration or four boxes in a side-by-side arrangement and either a front-to-rear or top-to-bottom arrangement. Other larger cartons that may store other multiples of boxes are also foreseen . . . .

The present invention also provides for the inserts storing the candy canes in a side-by-side arrangement ready for insertion into the boxes. By providing storage without the box, the candy canes may be produced and then stored in the inserts for extended periods of time prior to loading in the boxes at a later time. This also provides for producing the candy canes and inserts several months prior to loading into the boxes and spreading out production over the course of the entire year. Such a system also gives greater time to update packaging for the boxes from year to year without having to manufacture boxes at the same time as the candy canes.

These features of novelty and various other advantages that characterize the invention are pointed out with particularity in the claims annexed hereto and forming a part hereof. However, for a better understanding of the invention, its advantages, and the objects obtained by its use, reference should be made to the drawings that form a further part hereof, and to the accompanying descriptive matter, in which there is illustrated and described a preferred embodiment of the invention.

BRIEF DESCRIPTION OF THE DRAWINGS

Referring now to the drawings, wherein like reference letters and numerals indicate corresponding structure throughout the several views.

DETAILED DESCRIPTION OF THE PREFERRED EMBODIMENT

Figure 1:
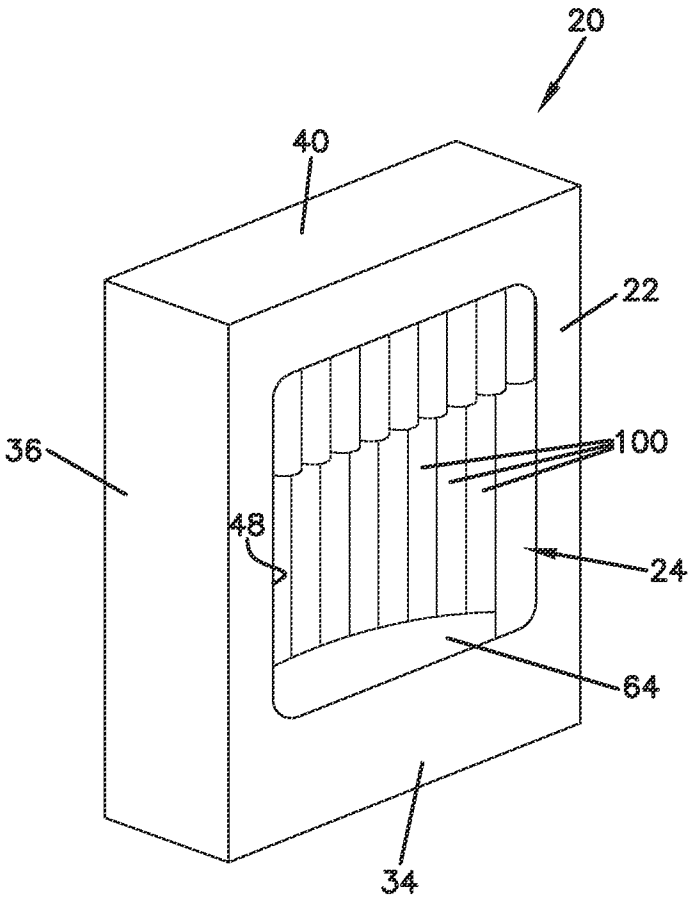
FIG. 1 is a perspective view of a box loaded with candy canes according to the principles of the present invention.

Referring now to the drawings and in particular to FIG. 1, there is shown a packaging system, generally designated (20). The packaging system (20) is configured for packaging candy and in particular for packaging and displaying candy canes (100). The packaging system (20) includes a box (22) and insert (24) for supporting the candy canes (100) and configured to insert into the box (22).

Figure 4:
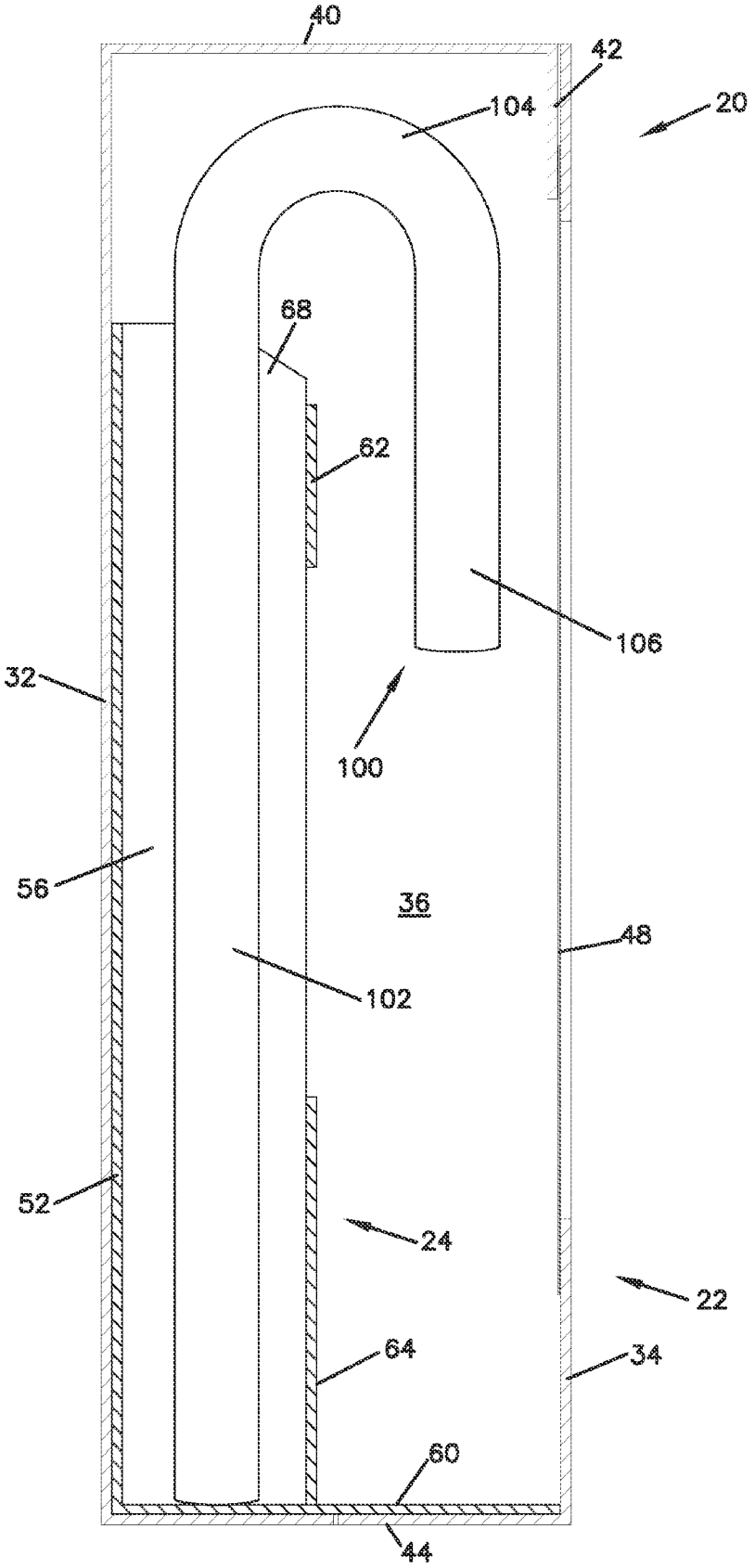
FIG. 4 is a side sectional view of the insert and the box.
Figure 5:
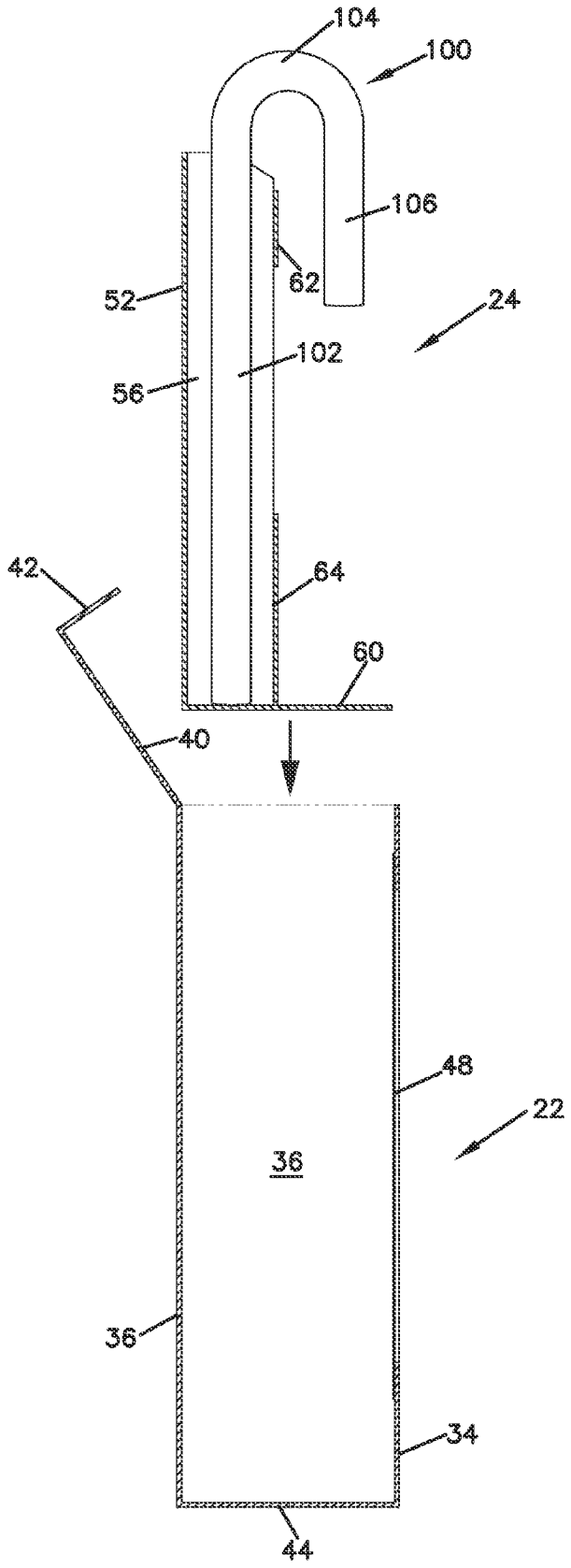
FIG. 5 is a side sectional view of the insert and the box prior to insertion of the insert into the box.
Figure 6:
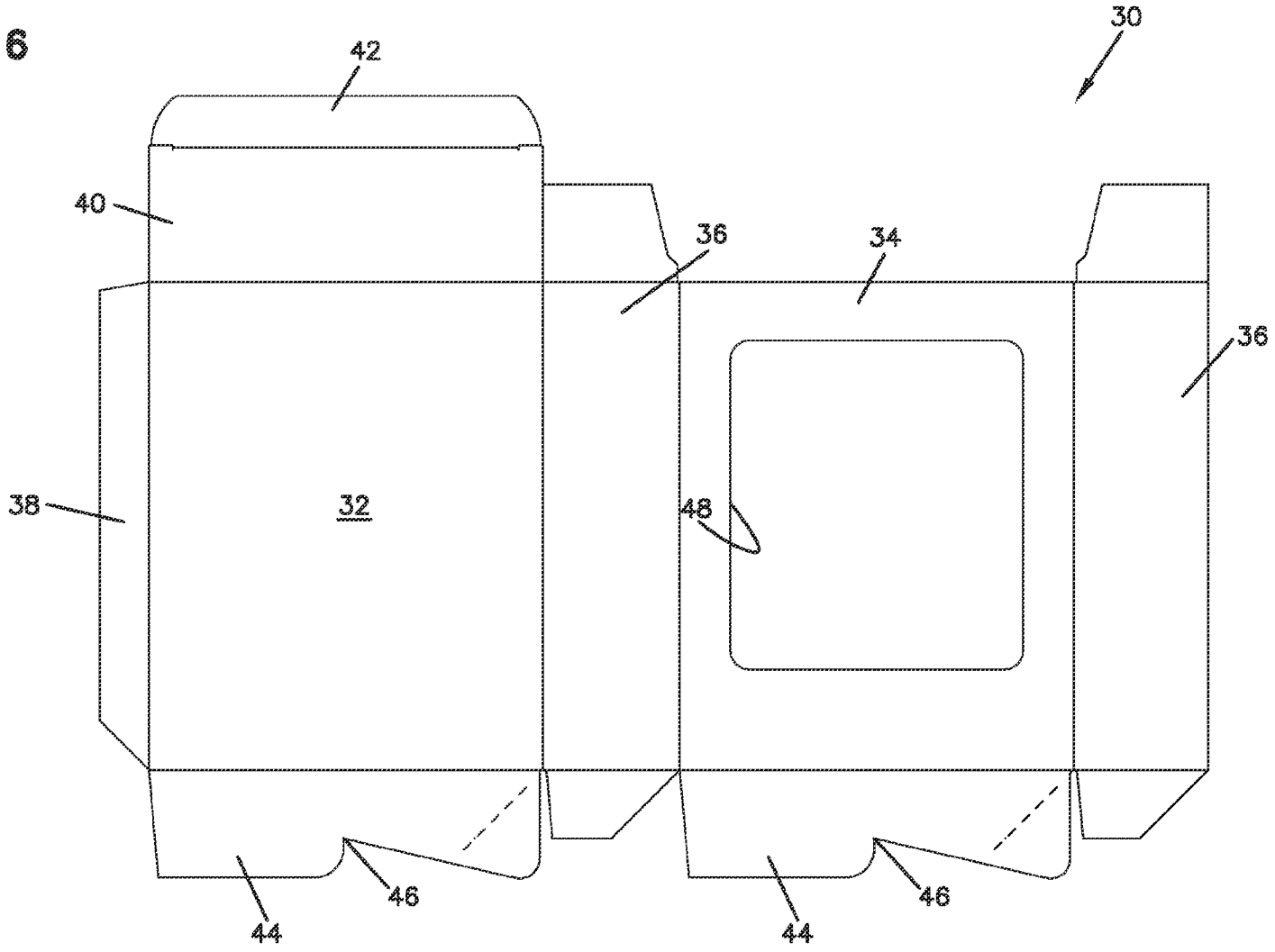
FIG. 6 is a top plan view of the blank for the box shown in FIG. 1.
Figure 7:
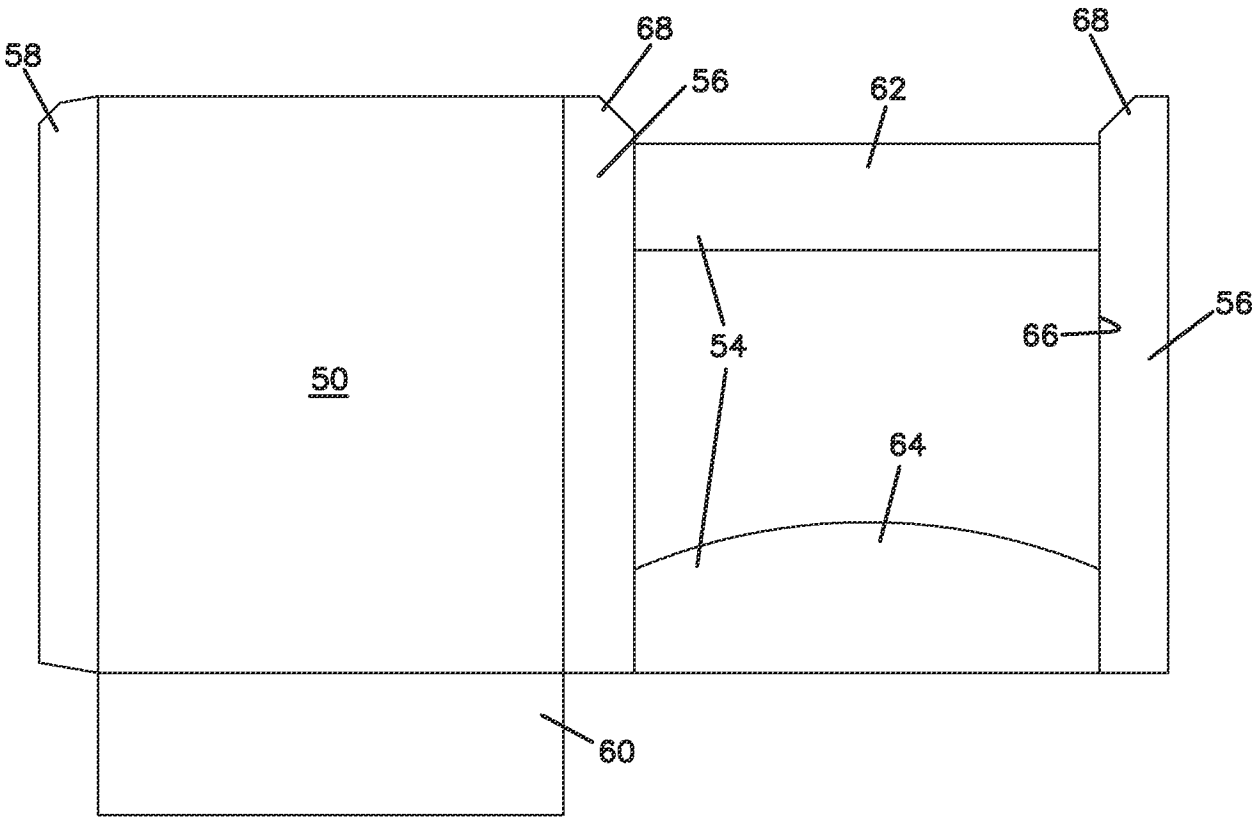
FIG. 7 is a top plan view of the blank for the insert shown in FIG. 2.

As shown most clearly in FIGS. 1, 4 and 5, the box (22) may be a conventional rectangular box configured for receiving the insert (24). The box (22) may be made from card stock or other conventional material from a blank (30), shown in FIG. 6. The blank (30) includes a back (32), a front (34) and opposed sides (36), that form the front (34), back (32) and sides of the box (22). The box (22) includes an openable top (40) with a top flap (42). The bottom of the box (22) is formed by intermeshing portions (44) that are opposed but interlock by use of aligned notches (46). The front (34) may include a window (48) that may be open or is covered with a clear sheet such as a plastic or other conventional material that is transparent to allow portions of the candy canes (100) and insert (24) to be viewed through the window (48).

Referring to FIGS. 2-5 and 7, the insert (24) is configured to support and retain the candy canes (100). The candy canes (100) have a generally round cross-section and are configured with an elongate section (102), a hook section (104) and a spaced apart end section (106) proximate the hook section (104). The insert (24) is made from a blank (50) shown in FIG. 7 that is cut and folded to achieve the final configuration of the insert (24). The blank (50) includes a back (52), a front (54) and opposed sides (56). A side flap (58) is configured for attaching to the opposite one of the sides (56). The insert (24) also includes a bottom (60) extending outward beyond the front (54) of the insert (24). The front (54) has a first cross piece (62) extending between the sides (56) and a second cross piece (64) spaced apart from the first cross piece and also extending between the sides (56). The first cross piece (62), the second cross piece (64) and the sides (56) form a front opening (66). In the embodiment shown, the second cross piece (64) has an arcing upper edge for ornamentation but it can be appreciated that other configurations may also be utilized. The sides (56) include angled top portions (68) that provide for engaging the inside of the top (40) of the box (22) and that extend upward beyond the first cross piece (62).

Figure 2:
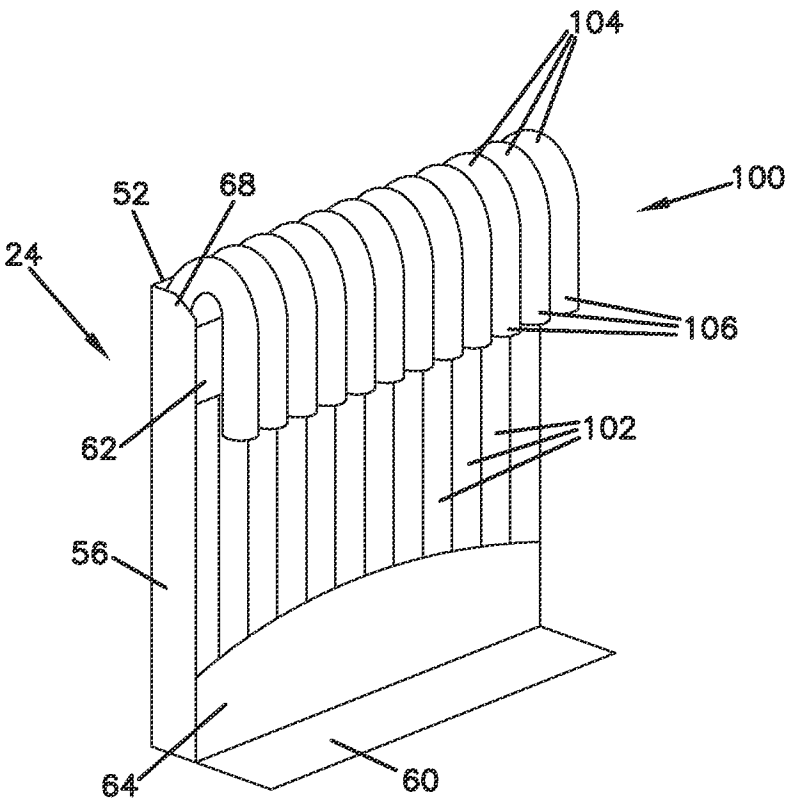
FIG. 2 is a perspective view of an insert loaded with candy canes.
Figure 3:
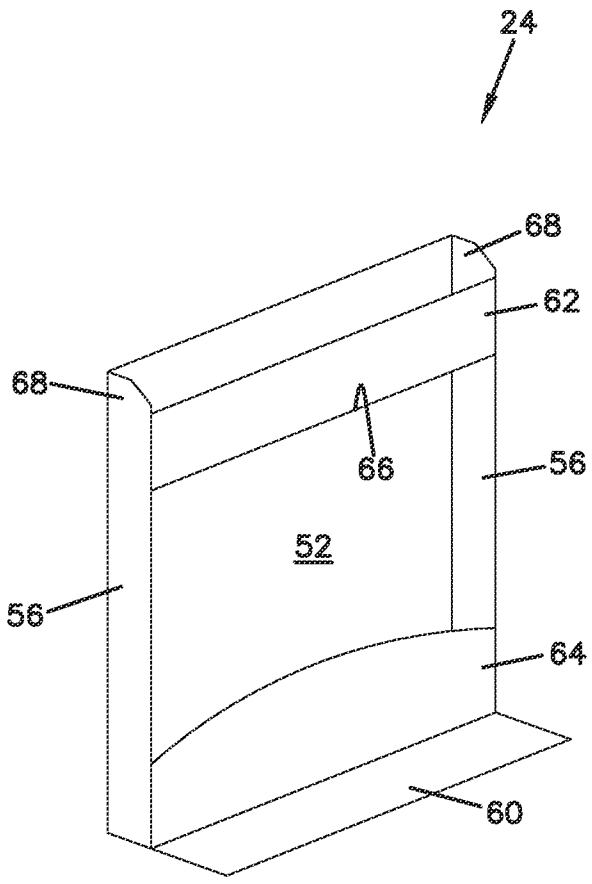
FIG. 3 is a perspective view of the insert without candy canes.

As shown in FIGS. 2 and 4, the candy canes (100) are supported with the elongate section (102) retained in the space formed between the first and second cross pieces (62, 64) and the back (52). The hook section (104) passes over and around the top of the first cross piece (62) and the hook ends (106) extend downward over the front of the first cross piece (62). Moreover, the bottom (60) extends forward beyond the sides (56) and the front formed by the cross pieces (62) and (64) to serve as a spacer, as explained hereinafter.

Referring to FIGS. 1, 4 and 5, the insert (24) is configured for top loading and inserting into the box (22). As shown in FIG. 5, the top (40) of the box (22) is opened to receive the insert (24). The candy canes (100) are loaded into the insert (24), as also shown in FIG. 2, and the insert (24) loaded with the candy canes (100) is slid through the opening in the top of the box (22). As shown in FIG. 4, the box (22) is then closed. The bottom (60) of the insert (24) engages the bottom portions (44) as well as the inside of the front (34) of the box (22). This engagement positions the insert (24) against the back (32) of the box (22) with the elongate sections (102) of the candy canes (100) being spaced inward and apart from the front of the box (22). The hooks (104) extend upward over and around the first cross piece (62) and proximate the top (40) and front (34) of the box (22). It can be appreciated that the window (48) is aligned so that when viewed from the exterior, a portion of the front of the second cross piece (64) as well as a portion of the candy canes (100) are visible.

With the configuration shown, it can be appreciated that the candy canes (100) may be stored in the insert (24) and do not immediately need to be placed in a box (22). Therefore, production may continue throughout the year and changes may be made to update graphics and other information on the box after the candy canes (100) are produced and stored in the insert (24). Moreover, versions of the box (22) having different graphics may be utilized with the same insert (24) and candy canes (100). It will also be appreciated that although the insert (24) and box (22) shown in FIGS. 1-7 are shown holding twelve candy canes (100), fewer or larger numbers of candy canes may be utilized with a narrower or wider insert (24) and box (22).

Figure 8:
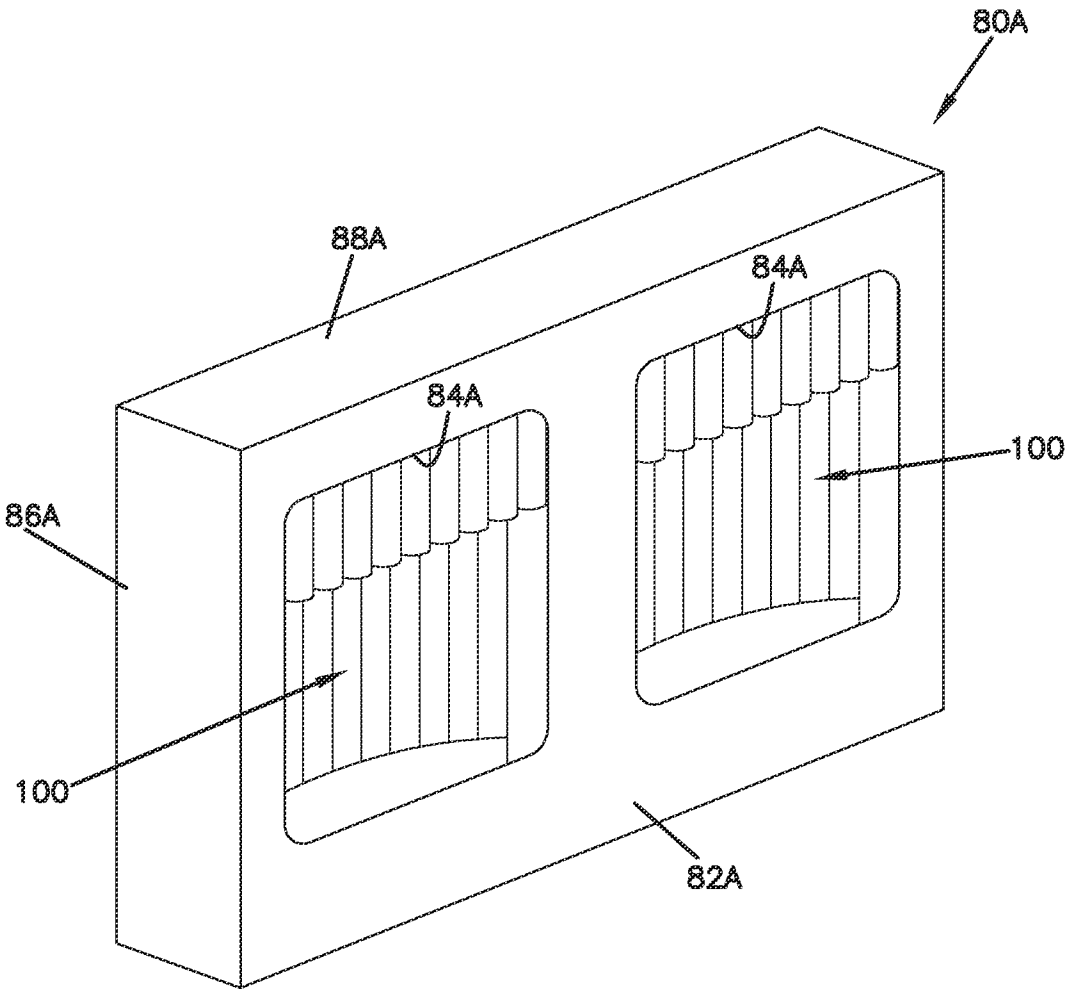
FIG. 8 is a perspective view of a first embodiment of a carton containing two of the boxes shown in FIG. 1.
Figures 9, 10, 11:
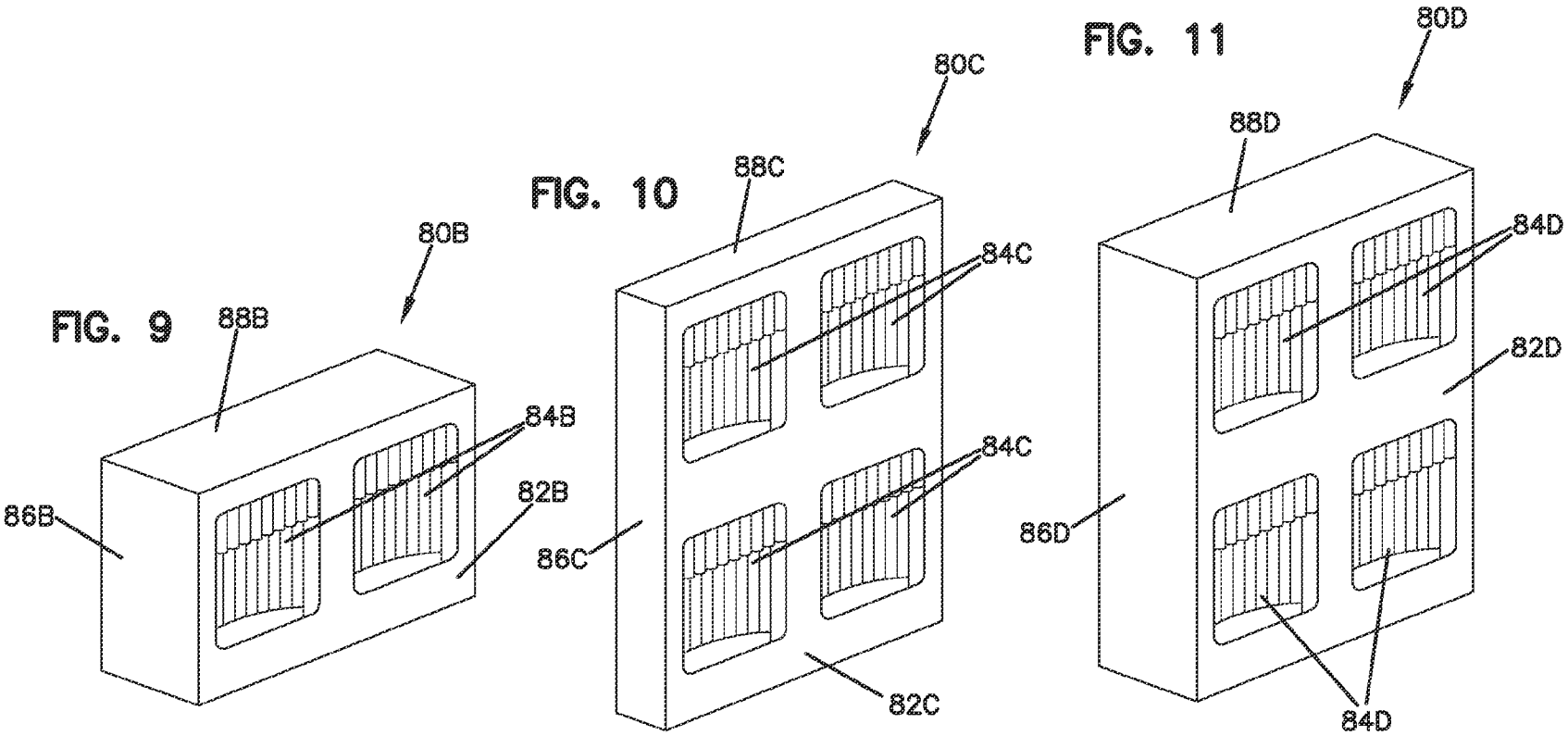
FIG. 9 is a perspective view of a second embodiment of a carton containing four of the boxes shown in FIG. 1.
FIG. 10 is a perspective view of a third embodiment of a carton containing four of the boxes shown in FIG. 1.
FIG. 11 is a perspective view of a third embodiment of a carton containing eight of the boxes shown in FIG. 1.

Referring to FIGS. 8-11, it can be appreciated that the boxes may also be placed inside of cartons (80A, 80B, 80C, 80D) should larger numbers of candy canes be shipped and/or packaged in larger numbers. The cartons include fronts (82A, 82B, 82C, 82D), tops (88A, 88B, 88C, 88D), sides (86A, 86B, 86C, 86D), backs (not shown) and bottoms (not shown). The fronts also include one or more windows (84A, 84B, 84C, 84D). The cartons provide for packaging multiple boxes (22) in a single packaging system. As shown in FIG. 8, the carton (80A) is configured for receiving two boxes (22). Moreover, as shown in FIG. 9, the carton (80B) is configured for receiving 4 of the boxes and holding 48 candy canes. As shown in FIG. 9, the carton (80B) is configured for receiving 4 boxes in a side-by-side and a front-to-rear configuration. Referring to FIG. 10, the carton (80C) is configured for receiving 48 candy canes in 4 boxes in a side-by-side and top-to-bottom configuration. Finally, in FIG. 11, the carton (80D) is configured for receiving 8 boxes and 96 candy canes with the boxes in a side-by-side and a 2×2×2 configuration. It can also be appreciated that other cartons are also envisioned holding different numbers of boxes of candy canes to meet the particular requirements for storage and marketing. The windows of the cartons provide for viewing the candy canes through the windows of the boxes and also provide for mixing and matching various designs of the boxes and cartons for a variety of packaging configurations.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A packaging system, comprising:

an insert defining a top, a bottom, a rear, a front and opposed sides, the insert comprising:

a rear portion, opposed side portions;

a first cross piece extending between the opposed sides spaced apart from the rear portion;

a second cross piece extending between the opposed sides coplanar with the first cross piece and spaced apart from the rear portion and proximate the bottom of the insert, wherein the opposed sides, the first cross piece and the second cross piece define a front opening;

a base portion extending below the rear portion, the opposed sides and the second cross piece and forward from the rear portion beyond the second cross piece;

an intersection defined by the base portion meeting a bottom edge of the second cross piece; the base portion having a front edge positioned forward beyond the intersection and substantially parallel to the intersection;

a box defining a front, a rear, a closable top, a bottom, and opposed sides; the box defining a front open section; the insert being configured to load into the box through the top when open with the front edge of the base portion of the insert engaging the front of the box, wherein the first and second cross pieces are spaced apart from the front of the box; and a carton configured to receive a plurality of the boxes.

2. The packaging system according to claim 1, wherein at least a portion of the front opening of the insert is aligned with the front open section of the box.

3. The packaging system according to claim 1, wherein the front open section of the box comprises a transparent layer.

4. The packaging system according to claim 1, wherein the front open section of the box comprises an opening.

5. The packaging system according to claim 1, wherein an upper edge of the second cross piece of the insert arcs.

6. The packaging system according to claim 1, wherein the opposed sides of the insert extend beyond an upper edge of the first cross piece.

7. The packaging system according to claim 1, wherein an upper edge of the first cross piece of the insert is spaced apart from the top of the box.

8. A candy cane packaging system for holding a plurality of candy canes, each of the candy canes having an elongate section and a hook section, the candy cane packaging system comprising:

an insert defining a top, a bottom, a rear, a front and opposed sides, the insert comprising:

a rear portion, opposed side portions;

a first cross piece extending between the opposed sides spaced apart from the rear portion;

a second cross piece extending between the opposed sides coplanar with the first cross piece and spaced apart from the rear portion and proximate the bottom of the insert, wherein the opposed sides, the first cross piece and the second cross piece define a front opening;

a base portion extending below the rear portion, the opposed sides and the second cross piece and forward from the rear portion beyond the second cross piece;

an intersection defined by the base portion meeting a bottom edge of the second cross piece; the base portion having a front edge positioned forward beyond the intersection and substantially parallel to the intersection;

a box defining a front, a rear, a closable top, a bottom, and opposed sides; the box defining a front open section; the insert being configured to load into the box through the top when open with the front edge of the base portion of the insert engaging the front of the box, wherein the first and second cross pieces are spaced apart from the front of the box;

the plurality of candy canes being contained to the box with the elongate section of each cane positioned intermediate the rear portion of the insert and the first and second cross pieces and with the hook section of each of the candy canes extending over the first cross piece and intermediate the first cross piece and the front of the box.

9. The candy cane packaging system according to claim 8, further comprising a carton configured to receive a plurality of the boxes.

10. The candy cane packaging system according to claim 8, wherein the opposed sides of the insert extend beyond an upper edge of the first cross piece.

11. The candy cane packaging system according to claim 8, wherein an upper edge of the first cross piece of the insert is spaced apart from the top of the box.

12. A candy cane packaging system for holding a plurality of candy canes, each of the candy canes having an elongate section and a hook section, the candy cane packaging system comprising:

an insert defining a top, a bottom, a rear, a front and opposed sides, the insert comprising:

a rear portion, opposed side portions;

a first cross piece extending between the opposed sides spaced apart from the rear portion, the opposed sides of the insert extending beyond an upper edge of the first cross piece;

a second cross piece extending between the opposed sides coplanar with the first cross piece and spaced apart from the rear portion and proximate the bottom of the insert, wherein the opposed sides, the first cross piece and the second cross piece define a front opening;

a base portion extending below the rear portion, the opposed sides and the second cross piece and forward from the rear portion beyond the second cross piece;

an intersection defined by the base portion meeting a bottom edge of the second cross piece; the base portion having a front edge positioned forward beyond the intersection and substantially parallel to the intersection;

a box defining a front, a rear, a closable top, a bottom, and opposed sides; the box defining a front open section; the insert being configured to load into the box through the top when open with the front edge of the base portion of the insert engaging the front of the box, wherein the first and second cross pieces are spaced apart from the front of the box and an upper edge of the first cross piece of the insert is spaced apart from the top of the box;

the plurality of candy canes being contained to the box with the elongate section of each cane positioned intermediate the rear portion of the insert and the first and second cross pieces and with the hook section of each of the candy canes extending over the first cross piece and intermediate the first cross piece and the front of the box.

13. The candy cane packaging system according to claim 12, further comprising a carton configured to receive a plurality of the boxes.

* * * * *